US006572110B1

(12) United States Patent
Knott

(10) Patent No.: US 6,572,110 B1
(45) Date of Patent: Jun. 3, 2003

(54) EDUCATIONAL AWARENESS GAME

(76) Inventor: Mark S. Knott, P.O. Box 204, Callaway, MD (US) 20620

( * ) Notice: Subject to any disclaimer, the term of this patent is extended or adjusted under 35 U.S.C. 154(b) by 0 days.

(21) Appl. No.: 10/164,578

(22) Filed: Jun. 10, 2002

(51) Int. Cl.[7] ..... A63F 3/00

(52) U.S. Cl. ..... 273/257; 273/243; 273/288; 273/249; 273/256

(58) Field of Search ..... 273/243, 248, 273/249, 251, 252, 256, 288, 257

(56) References Cited

U.S. PATENT DOCUMENTS 5,062,645 A * 11/1991 Goodman et al. ..... 273/249
5,139,268 A * 8/1992 Garnett ..... 273/249
5,350,179 A * 9/1994 Hill et al. ..... 273/249
6,425,582 B1 * 7/2002 Rosi ..... 273/243

FOREIGN PATENT DOCUMENTS

GB 709543 * 7/1952

* cited by examiner

*Primary Examiner*—Benjamin H. Layno
*Assistant Examiner*—Vishu K Mendiratta
(74) *Attorney, Agent, or Firm*—Kramer & Associates, P.C.

(57) ABSTRACT

A game for simulating possible experiences of a player using drugs or alcohol is disclosed. The game includes a fast path having a plurality of playing spaces and a slow path parallel to the fast path and having a plurality of spaces. There are at least two slow path spaces corresponding to one fast path playing space. The game also includes a fast game piece for movement along the fast path and a slow game piece for movement along the slow path. A chance piece is used for determining the movement of either the fast game piece or slow game piece along either the fast path or slow path. At least one of the playing spaces is a chance playing space and provides a chance for the player to move from the fast path to the slow path and from using the fast game piece to the slow game piece.

20 Claims, 7 Drawing Sheets

EDUCATIONAL AWARENESS GAME

BACKGROUND OF THE INVENTION

1. Field of the Invention

This invention relates generally to board games and more particularly to a board game for teaching the tragedies that may occur if substances such as alcohol, tobacco, and drugs are used or abused.

2. Description of Related Art

There are various board games that have been created to teach skills or moral lessons. For example, U.S. Pat. No. 5,071,134 issued to Burroughs, Jr. teaches a substance abuse board game apparatus and method of play. It educates the players about the consequences of the use of drugs and alcohol. It includes a game board having a playing path, a plurality of movable game pieces, a random number generator, a plurality of decks of question cards, a deck of penalty cards and a plurality of challenge tokens. The playing path is formed by a plurality of segments or spaces, each of which is provided with an identifying indicia corresponding to an identifying indicia of either one of the decks of question cards or the deck of penalty cards and a plurality of corner penalty segments. The playing path is a modified, substantially inwardly disposed spiral having an outer level, an intermediate level and an inner level. The outer level consists of a plurality of four different randomly disposed segments and the corner penalty spaces; the intermediate level consists of a plurality of five different randomly disposed segments and the corner penalty spaces; and the inner level consists of a plurality of six different randomly disposed segments and the corner penalty spaces.

U.S. Pat. No. 6,276,686 discloses a board game and method for teaching responsible drinking. It is for teaching responsible drinking to a plurality of players has a playing board having a start position and an end position connected by a pathway that extends about the surface of the playing board between the start position and the end position. The board game further includes a plurality of vehicle game pieces, each vehicle game pie being assigned to one of the plurality of players, and a plurality of a taxi game pieces. At least some of the playing positions provide an instruction, the instruction sometimes including a negative consequence of drinking instruction, or a cab calling instruction. The negative consequence of drinking instruction provides for some consequence having a negatively perceived effect upon the player who lands upon the playing position. The cab calling instruction allows the player to replace the vehicle game piece with the taxi game piece. The taxi game piece has the advantage of ignoring any of the negative consequence of drinking instructions upon which it might land, thereby teaching the players the desirability of calling a cab when a drinking.

The prior art shows various board games that teach moral lessons. However, the prior art does show games that simulate choices and consequences affecting game play and including the possibility of relapse.

Thus, it is an object of the present invention to provide an education game that demonstrates the costs and consequences of drug use.

It is another object of the present invention to provide an education game that demonstrates the costs and consequences of alcohol abuse especially drunk driving.

It is a further object of the present invention to provide an education game that demonstrates the benefits of leading a clean life.

It is a further object of the present invention to provide an education game that also demonstrates the possibility of relapse.

The foregoing objects and advantages of the invention are illustrative of those that can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variation which may be apparent to those skilled in the art. Accordingly, the present invention resides in the novel methods, arrangements, combinations and improvements herein shown and described.

SUMMARY OF THE INVENTION

In light of the present need for providing a game teaching the effects of drugs and alcohol on a persons life, a brief summary of the present invention is presented. Some simplifications and omission may be made in the following summary, which is intended to highlight and introduce some aspects of the present invention, but not to limit its scope. Detailed descriptions of a preferred exemplary embodiment adequate to allow those of ordinary skill in the art to make and use the invention concepts will follow in later sections.

A game for simulating possible experiences of a player using drugs or alcohol is disclosed. The game includes a fast path having a plurality of playing spaces and a slow path parallel to the fast path and having a plurality of spaces. There are at least two slow path spaces corresponding to one fast path playing space. The game also includes a fast game piece for movement along the fast path and a slow game piece for movement along the slow path. A chance piece is used for determining the movement of either the fast game piece or slow game piece along either the fast path or slow path. At least one of the playing spaces is a chance playing space and provides a chance for the player to move from the fast path to the slow path and from using the fast game piece to the slow game piece.

The game also includes a user track simulating drug and/or alcohol use and a sobriety track. Both track include the fast path and the slow path described above. The playing spaces on the sobriety track can be a work space providing money to the player, a relapse space causing the player to move to the user track, or a winning space. The playing spaces on the user track can be a sobriety space causing the player to move to the sobriety track, a work space providing money to the player, or a chance space possible subjecting the player to a negative consequence of alcohol or drug use.

BRIEF DESCRIPTION OF THE DRAWINGS

In order to better understand the present invention, reference is made to the accompanying drawings, wherein.

DETAILED DESCRIPTION OF THE PREFERRED EMBODIMENTS OF THE INVENTION

Figure 1:
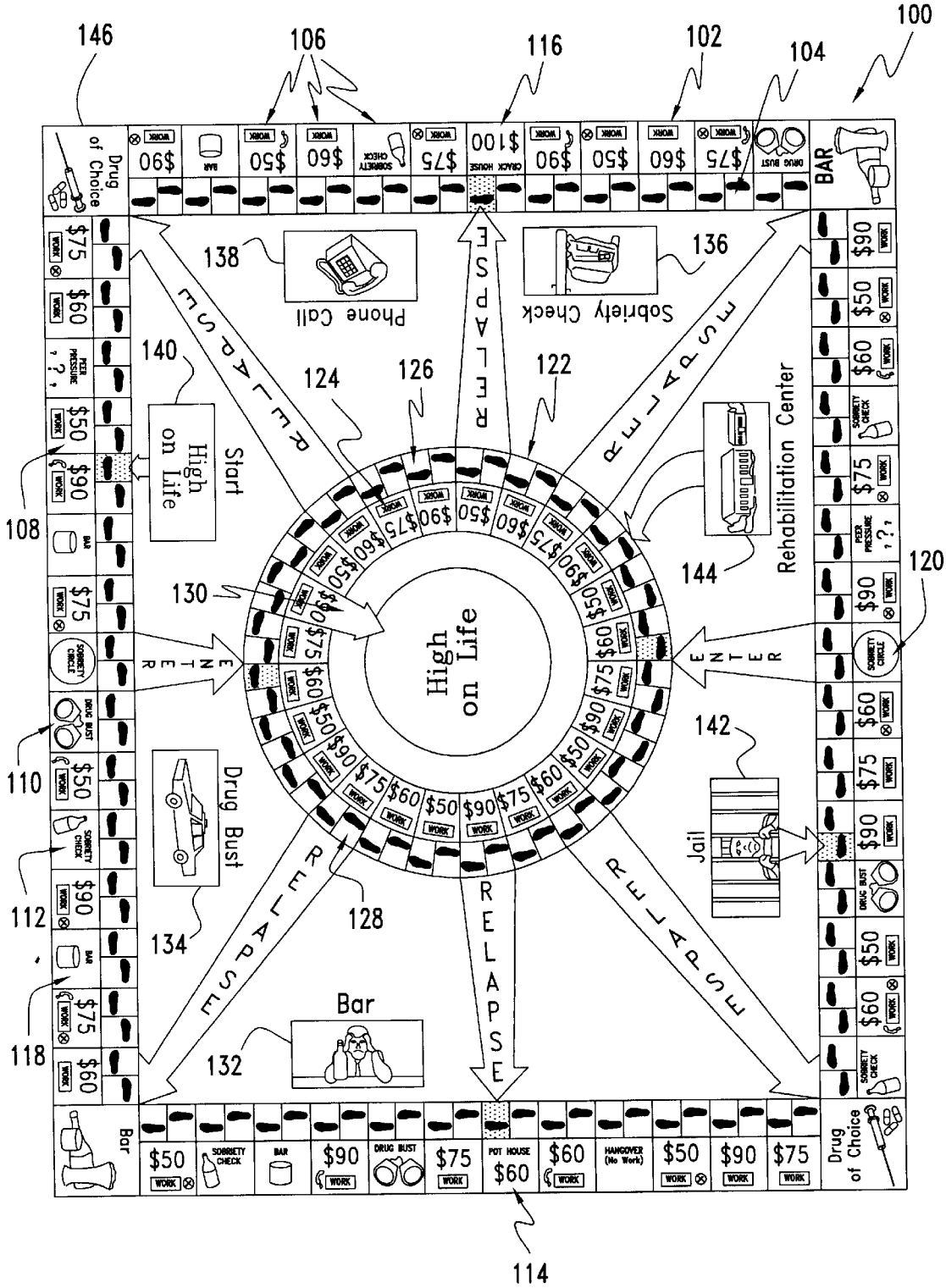
FIG. 1 shows an overhead view of the game board.

Referring now to the drawings, in which like numerals refer to like components or steps, there are disclosed broad aspects of the preferred embodiments of the present invention. FIG. 1 discloses a game board 100 having a driving path 102 and a walking path 104 both running parallel to one another along the outer edge of the board 100. The driving path 102 is separated into a plurality of playing spaces 106. The playing spaces 106 may include a work space 108, a drug bust space 110, a sobriety check space 112, a pot house space 114, a crack house space 116, a bar space 118 and a sobriety space 120. The walking path 104 is also separated into a plurality of spaces such that at least two of these spaces correspond to one playing space 106. Some of the work spaces 108 include a non-smoking symbol requiring the player to extinguish a cigarette if the player is currently smoking. Some of the work spaces 108 include a phone symbol.

The game board 100 also includes a sobriety circle 122 having a sobriety driving path 124 and a sobriety walking path 126 which are concentric. The paths 124 and 126 are arranged in a similar manner to the paths 102 and 104. The sobriety driving path 124 includes working spaces 108, relapse spaces 128, and at least one high on life space 130.

The game board 100 also includes a bar card marker 132, a drug bust card marker 134, a sobriety check card marker 136, a phone call card marker 138, a starting point area 140, a jail area 142 and a rehabilitation clinic area 144. The markers 132, 134, 136 and 138 are used to design areas for placing cards relating to the particular marker.

Figure 2:
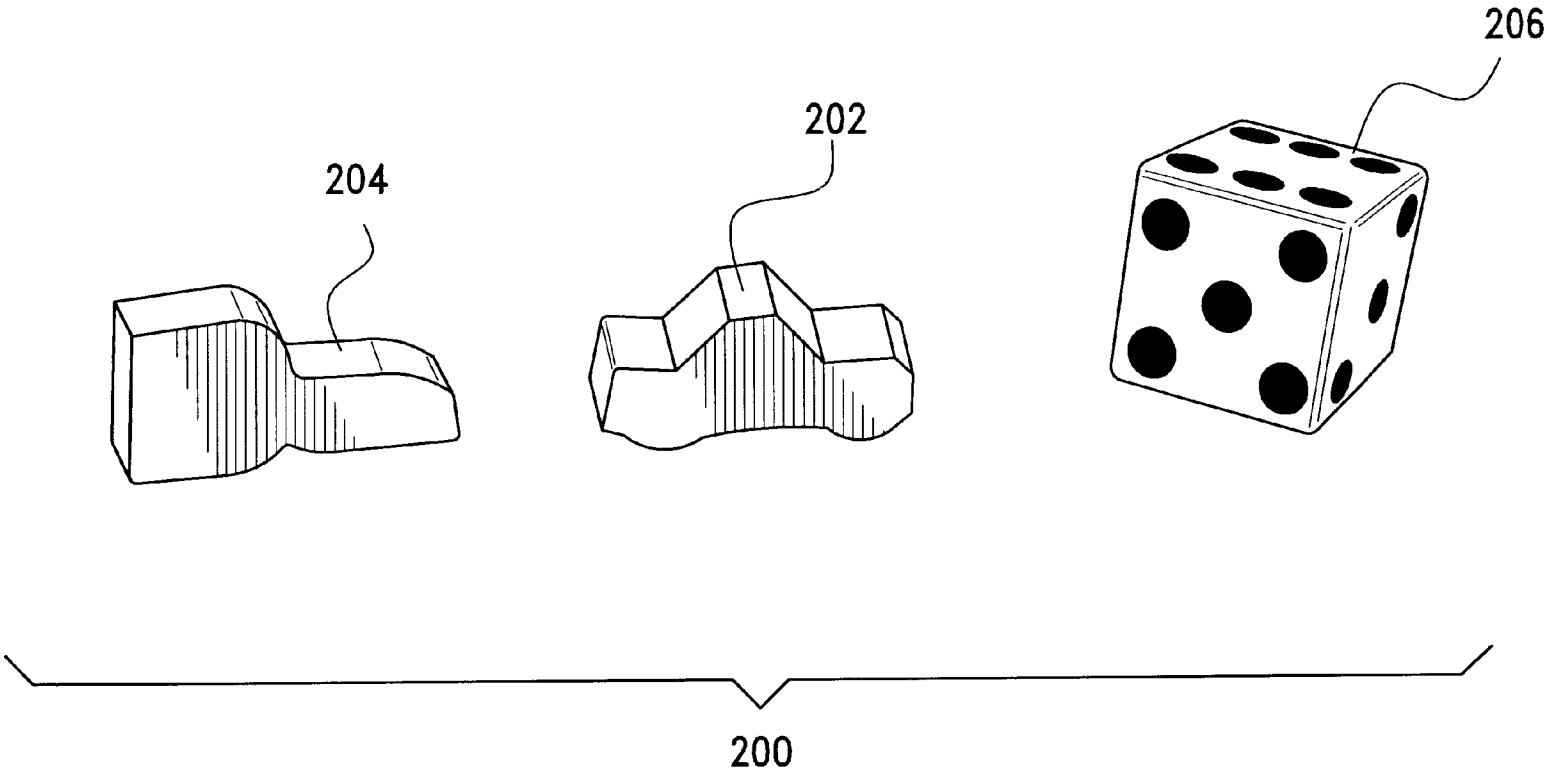
FIG. 2 shows a perspective view of the car and shoe game pieces along with a die used in the game.
Figure 3:
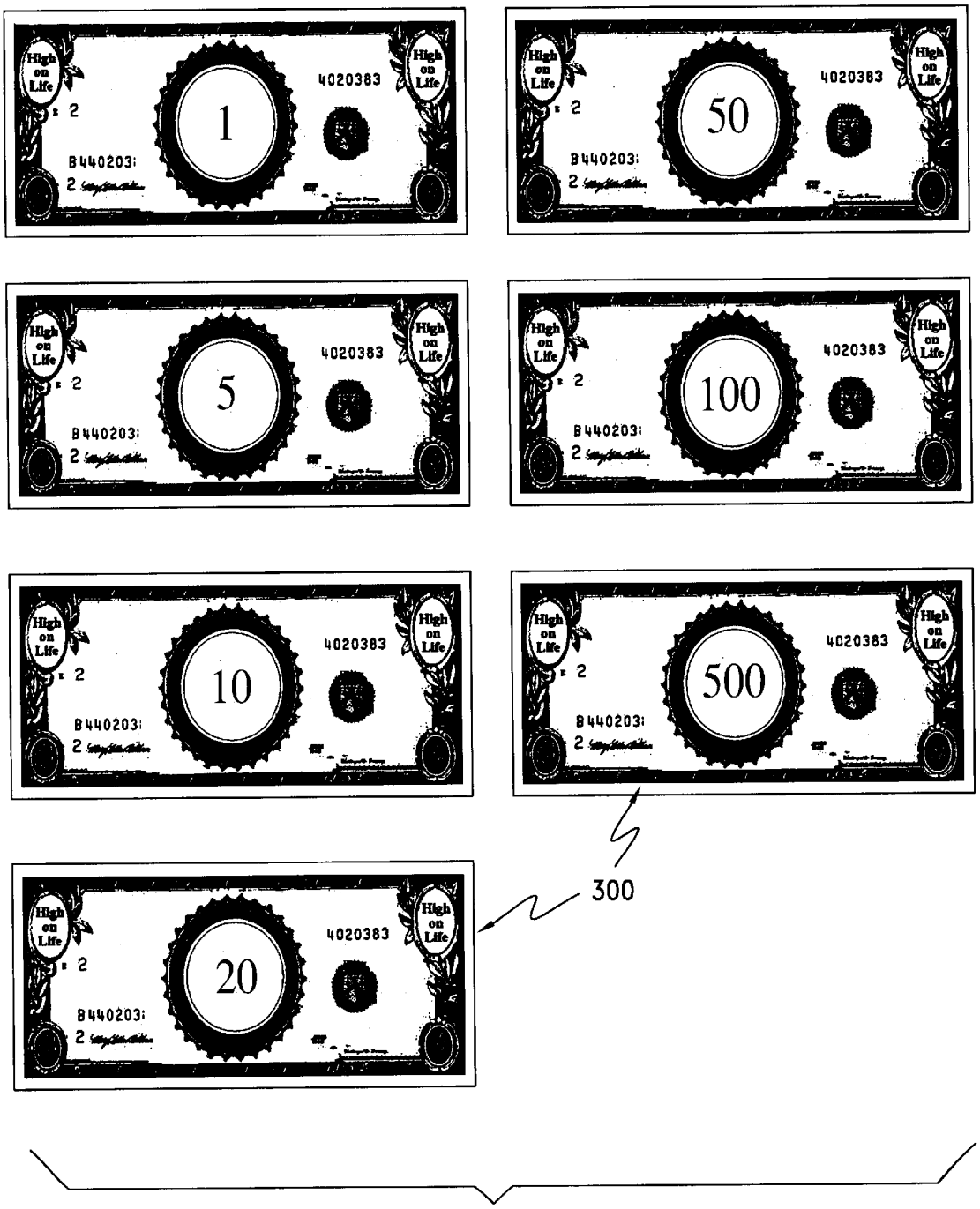
FIG. 3 shows an image of the play money used in the game.
Figure 4:
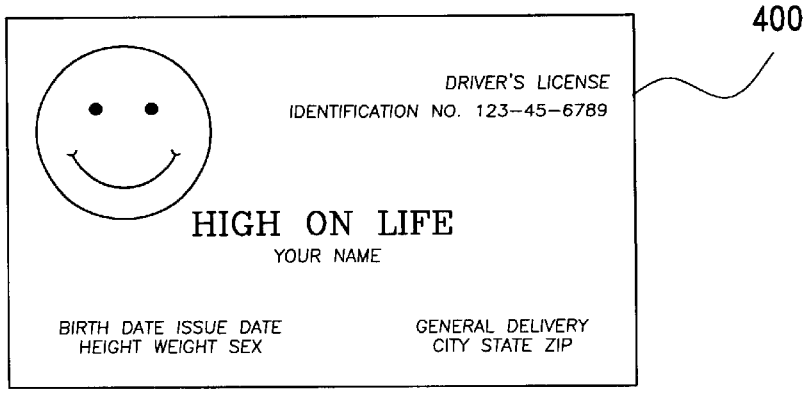
FIG. 4 shows an image of the driver's license used in the game.

Referring now to FIG. 2, playing pieces 200 are shown. A car 202 shaped playing piece is used by the player to traverse the board 100 along the driving path 102 or the sobriety driving path 124. A shoe 204 shaped playing piece is used by the player to traverse the board 100 along the walking path 104 or the sobriety walking path 126. A die 206 is used by the player to determine how many spaces the player is to traverse for each turn. FIG. 3 shows an image of play money 300 used in the game. The player collects money 300 when landing on a work space 108 and may lose money 300 during game play. Referring now to FIG. 4, a driver's license 400 is shown. The player is only allowed to use the car 202 while holding the driver's license 400.

Figure 5:
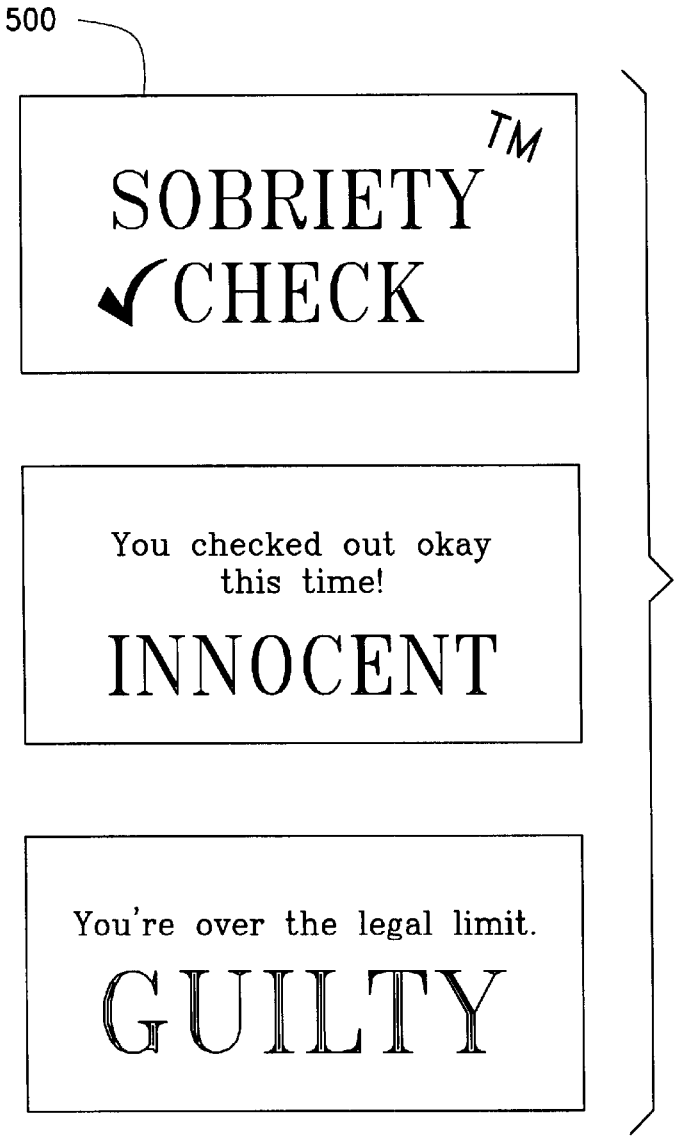
FIG. 5 shows both front and back images of the sobriety check cards used in the game.
Figure 6:
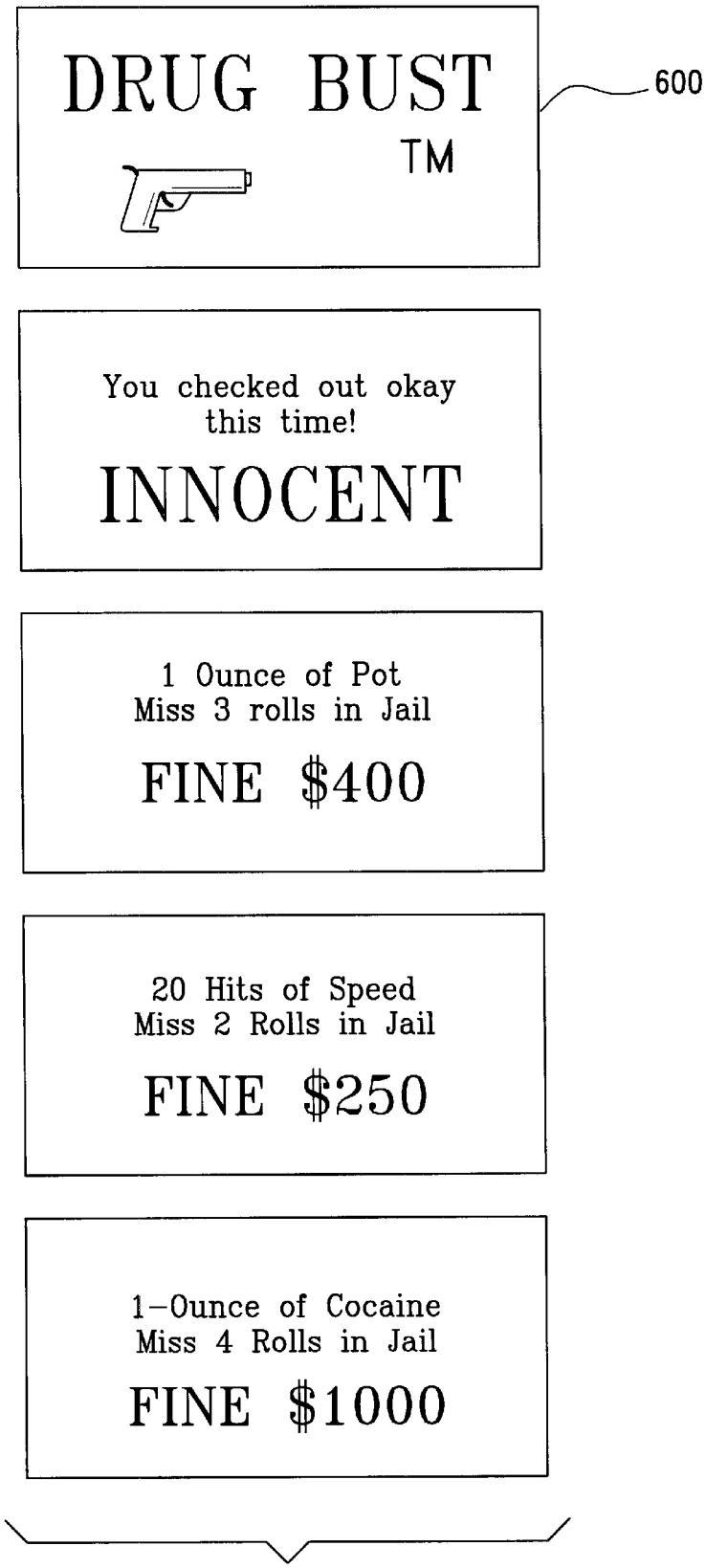
FIG. 6 shows both front and back images of the drug bust cards used in the game.
Figure 7:
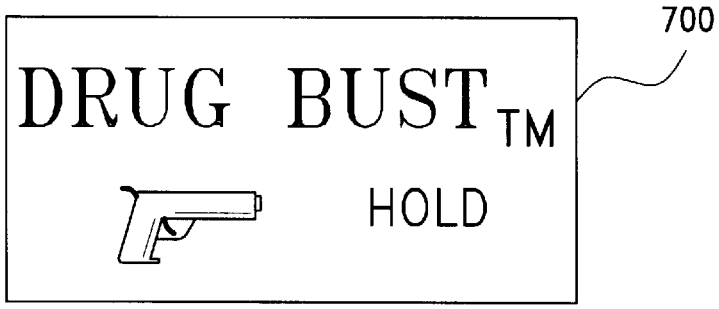
FIG. 7 shows an image of the drug bust hold cards used in the game.

FIG. 5 shows an image of the sobriety check cards 500. One side identifies the card as a sobriety check card 500. The other side states whether the player is innocent of guilty of driving while intoxicated. FIG. 6 shows images of the drug bust cards 600. One side identifies the card as a drug bust card 600. The other sides states whether the player is innocent or caught with drugs during a drug bust. The drug bust cards 600 can fine the player an amount of money 300 and potentially cause the player to go to jail 142. FIG. 7 shows a drug bust hold card 700. The card 700 is given to the player when the player is found guilty with a drug bust card 600 or a sobriety check card 500. Once the player accumulates a number of hold cards 700, the player must advance to the rehabilitation center 144.

Figure 8:
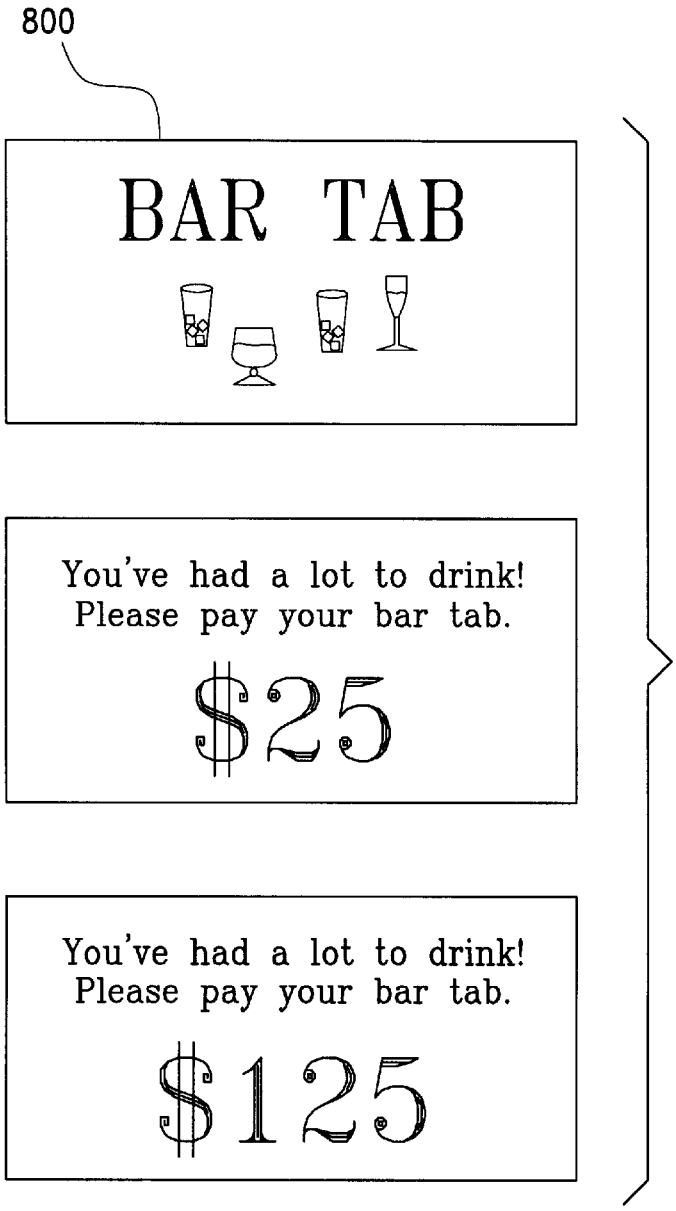
FIG. 8 shows both front and back images of the bar tab cards used in the game.
Figure 9:
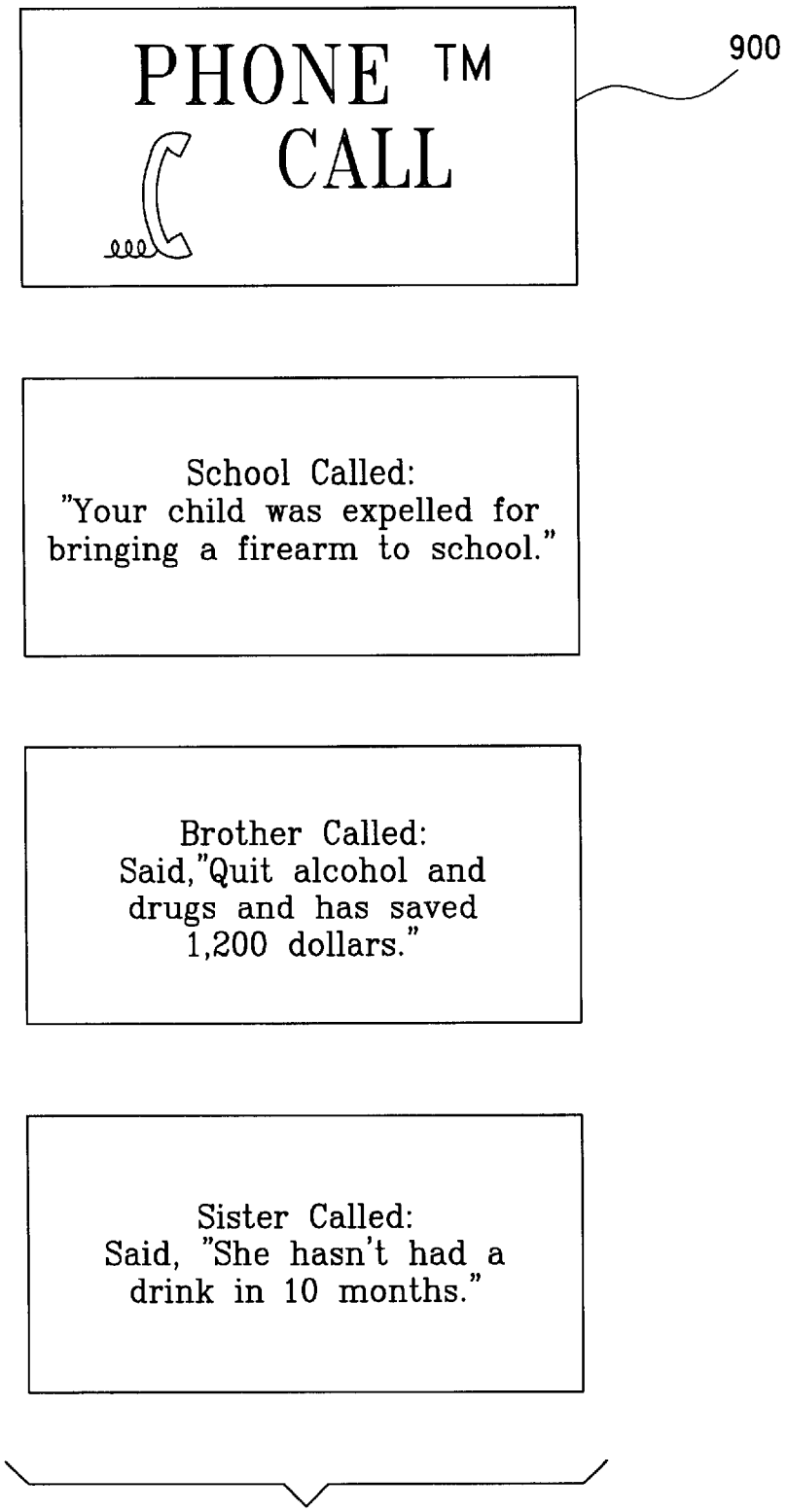
FIG. 9 shows an image of the phone call cards used in the game.

Referring now to FIG. 8, the game includes a number of bar tab cards 800. These cards 800 state an amount of money 300 that the player must pay. FIG. 9 shows phone call cards 900. These cards 900 represent a phone call from a person stating an event or fact related to drug or alcohol abuse. The facts or events are intended to education the player on potential pitfalls of drugs or alcohol or potential benefits of not using drugs or alcohol.

The method of playing the game will now be described in detail. The object of the game is for the player to move the game piece, the car 202 or shoe 204, from starting point area 140 to the high on life space 130 simulating a life free from alcohol and drugs. In preparation, the sobriety check cards 500 are placed on the sobriety check marker 136, the drug bust cards 600 are placed on the drug bust marker 134, the bar tab cards 800 are placed on the bar tab marker 132, and the phone call cards 900 are placed on the phone call marker 138. Each player receives car 202, a driver's license 400, a shoe 204 and $500 in play money 300.

Each player then rolls the die 206. The player that rolls the highest becomes the dealer. The dealer has several responsibilities. All drug buys are paid to the dealer. The dealer owns the crack house and the pot house. If the dealer enters the sobriety circle 122 the player to the right that is not in the sobriety circle 122 or the rehabilitation center 144 becomes the dealer. When all players are in the sobriety circle 122, the first person to relapse is the drug dealer. A player relapses when landing on a relapse space 128. When the drug dealer is killed all the dealer's belongings go back to the bank and phone call cards 900 are reshuffled at that time. The player to the right becomes the next dealer.

The player that rolls the lowest number on the die 206 becomes the banker. The banker pays players as they go around the board. If a player lands on a work space 108 the banker pays the player that amount of money 300 from the bank. The banker also distributes the drug bust hold cards 700 to the players and is responsible for keeping track of all debts. The banker holds any driver's licenses 400 that are suspended and returns them to the player when applicable. If the banker dies, the player to the right becomes the banker.

Once the dealer and banker determinations are made, game play can begin. The dealer rolls the die 206 and moves the car 202 along the driving path 102 the number of playing spaces 106 shown on the die 206. If or when the player loses the driver's license 400, the player must switch to using the shoe 204 and move along the walking path 104. After the player has completed a turn, the player to the left goes next. Two or more players may land on the same space. If a player lands on the dealer or the dealer lands on a player, the player must roll the die 206 and pay the dealer 20 times the number shown on the die.

If a player lands on a work space 108 including a phone symbol the player must draw a phone call card 900 and read it aloud to the remaining players. The object is to show the pain involved with substance abuse. If the player lands on a work space 108 including a nonsmoking symbol the player must extinguish a cigarette if currently smoking. The banker must also pay the player the amount of money 300 shown on the work space 108. Players may also sell their car 202 for $500 to pay any debts and buy back the car 202 for $550. Cars 202 lost through a drug bust may be bought back for $550. When the player loses the driver's license 400, sells the car 202 or loses the car 202, the player must switch to the shoe 204 and the walking path 104.

If a player lands on a drug bust space 110, the player must choose a drug bust card 600. If the card 600 indicates not guilty the turn is over. If the card 600 indicates guilty, a find, jail sentence or both are indicated. The player also gets a drug bust hold card 700, if a player has any 4 hold cards 700 at one time, the player must advance to the rehabilitation center 144 after paying fines and/or serving jail time.

If a player lands on the bar tab space 188, the player must choose a bar tab card 800 and pay the amount of money 300 indicated to the banker. If the player lands on the pot house space 114, the player must pay the amount indicated to the dealer. If the player lands on the crack house space 116, the player must pay the amount indicated to the dealer.

If a player lands on the sobriety check space 112, the player must choose a sobiety check card 500. If the card 500 indicates innocent, the player's turn is over. If the card 500 indicates guilty, the driver's license 400 is suspended and the car 202 is parked. The player must now use the shoe 204 and the walking path 104. If the player lands on the sobriety check space 112 while walking and the sobriety check card 500 indicates guilty, the player must pay a fine of $100 to the bank. Additionally, for the first offense, the player must pay a fine of $300 and go to jail 142. While in jail 142 the player loses one turn and leaves jail 142 using the shoe 204 until the license 400 is returned. The license 400 is returned after 3 turns. For the second offense, the player must pay a fine of $400 and go to jail 142. While in jail 142 the player loses two turns and leaves jail 142 using the shoe 204 until the license 400 is returned. The license 400 is returned after 4 turns. For the third offense, the player must pay a fine of $500 and go to jail 142. While in jail 142 the player loses three turns and leaves jail 142 using the shoe 204 until the license 400 is returned. The license 400 is returned after 5 turns. For the forth offense, the player must pay a fine of $500 and go to jail 142. While in jail 142 the player loses 4 turns and leaves jail 142 going directly to the rehabilitation center 144. If a player advances to the rehabilitation center, the player must miss two turns and advance to the sobriety circle. After leaving rehab, the hold cards 700 are returned and the offense number thereafter starts at one.

When a player lands on the drug of choice space 146, the player must roll the die 206 and pay the dealer 20 times the amount shown on the die 206. The drug of choice space 146, bar spaces 118, the pot house space 114 and the crack house space 116 are all directly accessible via a relapse while in the sobriety circle 122. While the player is traversing spaces around the sobriety circle 122, the player can either land on a work space 124, the high on life space 130, or a relapse space 128. If the player lands on the work space 124 the player is paid the amount shown. If the player lands on the relapse space 128, the player follows the route to either the drug of choice space 146, bar spaces 118, the pot house space 114 $\alpha$ the crack house space 116 and pays the dealer appropriately. If the player lands on the high on life space 130, the player wins and the game is over.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A game for simulating possible experiences of a player using drugs or alcohol, comprising:

a fast path having a plurality of playing spaces;

a slow path parallel to the fast path and having a plurality of spaces such that at least two slow path spaces correspond to one fast path playing space;

a fast game piece for movement along the fast path and not along the slow path;

a slow game piece for movement along the slow path and not along the fast path;

a chance piece for determining the movement of either the fast game piece or slow game piece along either the fast path or slow path, respectively; and wherein at least one playing space is a chance playing space and provides a chance for the player to move from the fast path to the slow path and change from the fast game piece to the slow game piece.

2. The game of claim 1, wherein the fast path simulates a road.

3. The game of claim 2, wherein the fast game piece is configured as a car.

4. The game of claim 3, wherein the slow path simulates a walkway and the slow game piece is configured as a shoe.

5. The game of claim 4, further comprising a plurality of chance cards including at least one intoxicated card declaring the player intoxicated and wherein the user must pick one of the cards when the user lands on the chance playing space.

6. The game of claim 5, wherein if the player picks the intoxicated card the player must move from the road with the car to the walkway with the shoe.

7. The game of claim 5, wherein at least one playing space is a work playing space giving the player a predetermined amount of money.

8. The game of claim 7, wherein the intoxicated card also fines the player a predetermined amount of money.

9. The game of claim 5, further comprising a holding area simulating a jail.

10. The game of claim 9, wherein if the player picks the intoxicated card the player must use the shoe as the game piece and move the shoe to the holding area.

11. The game of claim 1, wherein the slow path simulates a walkway.

12. The game of claim 11, wherein the slow game piece is configured as a shoe.

13. The game of claim 1, wherein at least one playing space is a work playing space giving the player a predetermined amount of money.

14. The game of claim 13, further comprising a plurality of chance cards including at least one guilty card declaring the player was found with drugs and wherein the user must pick one of the cards when the user lands on the chance playing space.

15. The game of claim 14, wherein if the player picks the guilty card the player is fined a predetermined amount of money.

16. The game of claim 1, further including a holding area simulating a jail.

17. The game of claim 16, further comprising a plurality of chance cards including at least one guilty card declaring the player was found with drugs and wherein the user must pick one of the cards when the user lands on the chance playing space.

18. The game of claim 17, wherein if the player picks the guilty card the player must move to the holding area.

19. A game for simulating possible experiences of a player using drugs or alcohol, comprising:

a user track simulating drug and/or alcohol use;

a sobriety track, the user track and sobriety track both including a fast path having a plurality of playing spaces and a slow path parallel to the fast path and having a plurality of spaces such that at least two slow path spaces correspond to one fast path playing space;

a fast game piece for movement along the fast path and not along the slow path;

a slow game piece for movement along the slow path and not along the fast path;

a change piece for determining the movement of either the fast game piece or slow game piece along either the fast path or slow path, respectively; and wherein at least one playing space on the sobriety track moves the player to the user track and at least one playing space on the user track moves the player to the sobriety track.

20. A game for simulating possible experiences of a player using drugs or alcohol, comprising:

a user track simulating drug and/or alcohol use;

a sobriety track, the user track and sobriety track both including a fast path having a plurality of playing spaces and a slow path parallel to the fast path and having a plurality of spaces such that at least two slow path spaces correspond to one fast path playing space;

a fast game piece for movement along the fast path and not along the slow path;

a slow game piece for movement along the slow path and not along the fast path;

a change piece for determining the movement of either the fast game piece or slow game piece along either the fast path or slow path, respectively; and wherein the playing spaces on the sobriety track can be a work space providing money to the player, a relapse space causing the player to move to the user track, or a winning space and the playing spaces on the user track can be a sobriety space causing the player to move to the sobriety track, a work space providing money to the player, or a chance space possible subjecting the player to a negative consequence of alcohol or drug use.

* * * * *